US006274029B1

(12) United States Patent
Wittenbrink et al.

(10) Patent No.: US 6,274,029 B1
(45) **Date of Patent: *Aug. 14, 2001**

(54) SYNTHETIC DIESEL FUEL AND PROCESS FOR ITS PRODUCTION

(75) Inventors: Robert Jay Wittenbrink; Richard Frank Bauman, both of Baton Rouge, LA (US); Paul Joseph Berlowitz, East Windsor; Bruce Randall Cook, Pittstown, both of NJ (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/464,179

(22) Filed: Dec. 16, 1999

Related U.S. Application Data

(63) Continuation of application No. 08/544,343, filed on Oct. 17, 1995.

(51) Int. Cl.[7] ..... C10L 1/04

(52) U.S. Cl. ..... 208/15; 208/17; 585/734; 585/1; 585/3

(58) Field of Search ..... 208/15, 17; 585/734, 585/1, 3

(56) References Cited

U.S. PATENT DOCUMENTS

| | | | |
|---|---|---|---|
| 2,243,760 | 5/1941 | Martin | 44/9 |
| 2,562,980 | 8/1951 | Atwell | 260/450 |
| 2,668,790 | 2/1954 | Good et al. | 196/50 |
| 2,668,866 | 2/1954 | Good et al. | 260/683.5 |
| 2,756,183 | 7/1956 | Knox, Jr. | 196/35 |
| 2,779,713 | 1/1957 | Cole et al. | 196/35 |
| 2,817,693 | 12/1957 | Koome et al. | 260/683.5 |
| 2,838,444 | 6/1958 | Teter et al. | 198/50 |
| 2,888,501 | 5/1959 | Folkins et al. | 260/683.65 |
| 2,892,003 | 6/1959 | Weisz | 260/683.65 |
| 2,906,688 | 9/1959 | Farmer et al. | 208/33 |
| 2,914,464 | 11/1959 | Burton et al. | 208/138 |
| 2,982,802 | 5/1961 | Folkins et al. | 260/683.65 |
| 2,993,938 | 7/1961 | Bloch et al. | 260/666 |
| 3,002,827 | 10/1961 | Fenske . | |

(List continued on next page.)

FOREIGN PATENT DOCUMENTS

| | | | |
|---|---|---|---|
| 275062 | 7/1964 | (AU) . | |
| 539698 | 4/1957 | (CA) . | |
| 700237 | 12/1964 | (CA) . | |
| 954058 | 9/1974 | (CA) | 196/54 |
| 3030998 | 4/1982 | (DE) . | |
| 2251156 | 4/1993 | (DE) . | |
| 0113045A1 | 7/1984 | (EP) | C10M/1/48 |
| 0153782 | 9/1985 | (EP) | B10J/37/26 |
| 0227218A1 | 7/1987 | (EP) | C10L/1/18 |
| 0266898A2 | 5/1988 | (EP) | B01J/23/74 |
| 0281992A3 | 9/1988 | (EP) | C10M/101/02 |
| 0323092 | 12/1988 | (EP) . | |
| 0321301A3 | 6/1989 | (EP) | B01J/23/40 |
| 0418860A1 | 3/1991 | (EP) | C10M/169/04 |
| 0374461B1 | 5/1992 | (EP) | C10L/1/14 |
| 0515256A1 | 11/1992 | (EP) . | |
| 0515270A1 | 11/1992 | (EP) . | |
| 0532117 | 3/1993 | (EP) . | |
| 0532117A1 | 3/1993 | (EP) . | |
| 0532118 | 3/1993 | (EP) . | |

(List continued on next page.)

OTHER PUBLICATIONS

Ward, "Compos. of F–T Diesel Fuel", Div. Pet. Chem. 117th Mtg. ACS (1950).

Morgan et al, "Some Comparative Chemical, Physical and Compatibility Properties of Sasol Slurry Phase Distillate Diesel Fuel", SAE No. 982488 (1998), pp. 1–9.

Agee, "A New Horizon For Synthetic Fuels", World Conference on Transportation Quality Oct. 6–8, 1996.

Norton et al, "Emissions from Trucks using Fischer–Tropsch Diesel Fuel", SAE No. 982526, pp. 1–10 (1998).

Booth et al (Shell) "Severe hydrotreating of diesel can cause fuel–injector pump failure", PennWell Publishing Company, Oil & Gas Journal (Aug. 16, 1993).

The Clean Fuels Report, "Volvo Demonstrates Benefits of Reformulated Diesel" "Research and Technology", pp. 166–170, Sep. 1995.

The Clean Fuels Report, "Cetane Number is Major Control for Diesel Emissions with Catalyst", pp. 170–173, Sep. 1995.

Signer et al, "European Programme on Emissions, Fuels and Engine Technologies (EPEFE)—Heavy Duty Diesel Study", SAE No. 961074, pp. 1–21, International Sprin Guels & Lubricants Meeting, Michigan, May 6–8, 1996.

Erwin et al., "The Standing of Fischer–Tropsch Diesel in an Assay of Fuel Performance and Emissons", Southwest Research Institute, Contract No. NREL SUB YZ–2–113215–1 (Oct. 26, 1993).

M'Hamdi et al, "Packed Column SFC of Gas Oils", J. High Resol. Chromatogr., vol. 21, pp. 94–102 (Feb. 1998).

Fraile et al, "Experimental Design Optimization of the Separation of the Aromatic Compounds in Petroleum Cuts by Supercricial Fluid Chromatography", Journal of High Resolution Chromatography, vol. 16, pp. 169–174 (Mar. 1993).

(List continued on next page.)

*Primary Examiner*—Helane E. Myers

(57) ABSTRACT

Diesel fuels or blending stocks having excellent lubricity, oxidative stability and high cetane number are produced from non-shifting Fischer-Tropsch processes by separating the Fischer-Tropsch product into a lighter and heavier fractions, e.g., at about 700° F., subjecting the 700° F.+fraction to hydro-treating, and combining the 700° F.+portion of the hydrotreated product with the lighter fraction that has not been hydrotreated.

11 Claims, 2 Drawing Sheets

U.S. PATENT DOCUMENTS

| | | | |
|---|---|---|---|
| 3,052,622 | 9/1962 | Johnson et al. | 208/27 |
| 3,078,323 | 2/1963 | Kline et al. | 260/683.65 |
| 3,121,696 | 2/1964 | Hoekstra | 252/441 |
| 3,123,573 | 3/1964 | Carr | 252/442 |
| 3,125,511 | 3/1964 | Tupman et al. | 208/264 |
| 3,147,210 | 9/1964 | Hass et al. | 208/210 |
| 3,206,525 | 9/1965 | Michaels et al. | 260/683.66 |
| 3,253,055 | 5/1966 | Goble et al. | 260/683.75 |
| 3,268,436 | 8/1966 | Arey, Jr. et al. | 208/59 |
| 3,268,439 | 8/1966 | Tupman et al. | 208/112 |
| 3,308,052 | 3/1967 | Ireland et al. | 208/27 |
| 3,338,843 | 8/1967 | Goble et al. | 252/442 |
| 3,340,180 | 9/1967 | Beuther et al. | 208/108 |
| 3,365,390 | 1/1968 | Egan et al. | 208/60 |
| 3,395,981 | 8/1968 | Kischio . | |
| 3,404,086 | 10/1968 | Plank et al. | 208/120 |
| 3,471,399 | 10/1969 | O'Hara | 206/216 |
| 3,486,993 | 12/1969 | Egan et al. | 208/89 |
| 3,487,005 | 12/1969 | Egan et al. | 208/59 |
| 3,507,776 | 4/1970 | Hann | 208/85 |
| 3,530,061 | 9/1970 | Orkin et al. | 208/60 |
| 3,594,307 | 7/1971 | Kirk, Jr. | 208/57 |
| 3,607,729 | 9/1971 | Robinson et al. | 208/112 |
| 3,619,408 | 11/1971 | Larson | 208/80 |
| 3,620,960 | 11/1971 | Kozlowski et al. | 208/60 |
| 3,629,096 | 12/1971 | Divijak, Jr. | 208/89 |
| 3,630,885 | 12/1971 | Egan | 208/59 |
| 3,658,689 | 4/1972 | Steinmetz et al. | 208/46 |
| 3,660,058 | 5/1972 | Feldman et al. | 44/80 |
| 3,668,112 | 6/1972 | Parker . | |
| 3,668,113 | 6/1972 | Burbidge . | |
| 3,674,681 | 7/1972 | Lyon | 208/141 |
| 3,681,232 | 8/1972 | Egan | 208/80 |
| 3,684,695 | 8/1972 | Neel et al. | 208/110 |
| 3,692,695 | 9/1972 | Suggitt et al. | 252/439 |
| 3,692,697 | 9/1972 | Kravitz et al. | 252/439 |
| 3,709,817 | 1/1973 | Suggitt et al. | 208/112 |
| 3,711,399 | 1/1973 | Estes et al. | 208/112 |
| 3,717,586 | 2/1973 | Suggitt et al. | 252/439 |
| 3,725,302 | 4/1973 | Shimely | 252/431 R |
| 3,761,388 | 9/1973 | Bryson et al. | 208/59 |
| 3,767,562 | 10/1973 | Sze et al. | 208/57 |
| 3,770,618 | 11/1973 | Adams | 208/216 |
| 3,775,291 | 11/1973 | Sze | 208/57 |
| 3,794,580 | 2/1974 | Ladeur | 208/110 |
| 3,814,682 | 6/1974 | Christman et al. | 208/216 |
| 3,830,723 | 8/1974 | Ladeur et al. | 208/108 |
| 3,830,728 | 8/1974 | Mounce | 208/59 |
| 3,840,508 | 10/1974 | Ballard et al. | 260/88.2 R |
| 3,840,614 | 10/1974 | Kravitz et al. | 260/683.68 |
| 3,843,509 | 10/1974 | Suto et al. | 208/111 |
| 3,843,746 | 10/1974 | Kravitz et al. | 260/683.68 |
| 3,848,018 | 11/1974 | Robson | 260/683.65 |
| 3,852,186 | 12/1974 | Christman et al. | 208/89 |
| 3,852,207 | 12/1974 | Stangeland et al. | 208/58 |
| 3,861,005 | 1/1975 | Steinmetz et al. | 208/111 |
| 3,864,425 | 2/1975 | Gardner | 260/683.68 |
| 3,870,622 | 3/1975 | Ashton et al. | 208/93 |
| 3,876,522 | 4/1975 | Campbell et al. | 208/58 |
| 3,887,455 | 6/1975 | Hamner | 208/112 |
| 3,915,843 | 10/1975 | Franck et al. | 208/112 |
| 3,963,601 | 6/1976 | Hilfman | 208/111 |
| 3,976,560 | 8/1976 | Erickson | 208/138 |
| 3,977,961 | 8/1976 | Hamner | 208/59 |
| 3,977,962 | 8/1976 | Arey, Jr. et al. | 208/59 |
| 3,979,279 | 9/1976 | Yan | 208/264 |
| 4,014,821 | 3/1977 | Hamner | 252/470 |
| 4,032,304 | 6/1977 | Dorer, Jr. et al. | 44/70 |
| 4,032,474 | 6/1977 | Goudriaan et al. | 252/441 |
| 4,041,095 | 8/1977 | Kuo | 260/676 |
| 4,051,021 | 9/1977 | Hamner | 208/216 |
| 4,059,648 | 11/1977 | Derr et al. | 260/676 R |
| 4,067,797 | 1/1978 | Chen | 208/15 |
| 4,073,718 | 2/1978 | Hamner | 208/80 |
| 4,087,349 | 5/1978 | Baird, Jr. . | |
| 4,125,566 | 11/1978 | Dinh | 260/676 |
| 4,139,494 | 2/1979 | Itoh et al. | 252/455 R |
| 4,162,962 | 7/1979 | Stangeland | 208/58 |
| 4,186,078 | 1/1980 | Itoh et al. | 208/27 |
| 4,212,771 | 7/1980 | Hamner | 252/455 Z |
| 4,263,127 | 4/1981 | Rausch et al. | 208/58 |
| 4,304,871 | 12/1981 | Brennanet al. | 518/717 |
| 4,342,641 | 8/1982 | Reif et al. | 208/89 |
| 4,378,973 | 4/1983 | Sweeney | 44/56 |
| 4,390,414 | 6/1983 | Cody | 208/111 |
| 4,394,251 | 7/1983 | Miller | 208/111 |
| 4,427,534 | 1/1984 | Brunn et al. | 208/89 |
| 4,427,791 | 1/1984 | Miale | 502/203 |
| 4,428,819 | 1/1984 | Shu et al. | 208/46 |
| 4,444,895 | 4/1984 | Fung et al. | 502/37 |
| 4,451,572 | 5/1984 | Cody | 502/62 |
| 4,472,529 | 9/1984 | Johnson et al. | 502/228 |
| 4,477,586 | 10/1984 | McDaniel | 502/104 |
| 4,518,395 | 5/1985 | Petronella | 44/53 |
| 4,527,995 | 7/1985 | Itow et al. | 44/56 |
| 4,529,526 | 7/1985 | Inoue et al. | 252/32.7 E |
| 4,539,014 | 9/1985 | Sweeney | 44/56 |
| 4,568,663 | 2/1986 | Mauldin | 502/325 |
| 4,579,986 | 4/1986 | Sie | 585/324 |
| 4,588,701 | 5/1986 | Chiang | 502/65 |
| 4,594,172 | 6/1986 | Sie | 252/55 |
| 4,599,162 | 7/1986 | Yen | 208/59 |
| 4,608,151 | 8/1986 | Miller | 208/33 |
| 4,618,412 | 10/1986 | Hudson et al. | 208/59 |
| 4,627,908 | 12/1986 | Miller | 208/58 |
| 4,645,585 | 2/1987 | White | 208/58 |
| 4,673,487 | 6/1987 | Miller | 208/58 |
| 4,684,756 | 8/1987 | Derr, Jr. et al. | 585/330 |
| 4,695,365 | 9/1987 | Ackelson | 208/89 |
| 4,755,280 | 7/1988 | Hudson et al. | 208/89 |
| 4,764,266 | 8/1988 | Chen et al. | 208/58 |
| 4,804,802 | 2/1989 | Evans | 587/734 |
| 4,832,819 | 5/1989 | Hamner | 208/27 |
| 4,851,109 | 7/1989 | Chen et al. | 208/58 |
| 4,855,530 | 8/1989 | LaPierre et al. | 585/739 |
| 4,875,992 | 10/1989 | Hamner | 208/89 |
| 4,900,707 | 2/1990 | Cody et al. | 502/230 |
| 4,906,599 | 3/1990 | Cody et al. | 502/62 |
| 4,911,821 | 3/1990 | Katzer et al. | 208/27 |
| 4,919,786 | 4/1990 | Hamner | 208/27 |
| 4,919,788 | 4/1990 | Chen et al. | 208/59 |
| 4,923,841 | 5/1990 | Hamner | 502/230 |
| 4,929,795 | 5/1990 | Cody et al. | 585/739 |
| 4,937,399 | 6/1990 | Wachter et al. | 585/749 |
| 4,943,672 | 7/1990 | Hamner | 585/737 |
| 4,959,337 | 9/1990 | Cody et al. | 502/230 |
| 4,960,504 | 10/1990 | Pellet | 208/411 |
| 4,962,269 | 10/1990 | LaPierre et al. | 585/739 |
| 4,982,031 | 1/1991 | Chen | 208/324 |
| 4,990,713 | 2/1991 | Le et al. | 585/332 |
| 4,992,159 | 2/1991 | Cody | 585/734 |
| 4,992,406 | 2/1991 | Mauldin | 502/325 |
| 5,037,528 | 8/1991 | Garwood et al. | 208/27 |
| 5,059,299 | 10/1991 | Cody | 585/737 |
| 5,059,741 | 10/1991 | Foley | 585/734 |
| 5,110,445 | 5/1992 | Chen et al. | 208/505 |
| 5,156,114 | 10/1992 | Gunnerman . | |
| 5,157,187 | 10/1992 | Le et al. | 585/208 |
| 5,158,671 | 10/1992 | Cody et al. | 208/264 |
| 5,183,556 | 2/1993 | Reilly et al. | 208/57 |
| 5,187,138 | 2/1993 | Davis | 502/255 |

| | | | |
|---|---|---|---|
| 5,281,347 | 1/1994 | Igarashi et al. | 252/42.7 |
| 5,282,958 | 2/1994 | Santilli et al. | 208/585 |
| 5,292,988 | 3/1994 | Wu | 585/741 |
| 5,292,989 | 3/1994 | Davis | 585/751 |
| 5,302,279 | 4/1994 | Degnan et al. | 208/87 |
| 5,306,860 | 4/1994 | Bigeard et al. | 585/737 |
| 5,308,365 | 5/1994 | Kesling | 44/447 |
| 5,324,335 | 6/1994 | Benham | 44/452 |
| 5,345,019 | 9/1994 | Bigeard et al. | 585/264 |
| 5,348,982 | 9/1994 | Herbolzheimer et al. | 518/700 |
| 5,362,378 | 11/1994 | Borghard et al. | 208/138 |
| 5,370,788 | 12/1994 | Dai . | |
| 5,378,249 | 1/1995 | Morrison | 44/388 |
| 5,378,348 | 1/1995 | Davis et al. | 208/27 |
| 5,378,351 | 1/1995 | Guichard et al. | 208/143 |
| 5,385,588 | 1/1995 | Brennan | 44/331 |
| 5,479,775 | 1/1996 | Kraemer et al. | 60/274 |
| 5,500,449 | 3/1996 | Benham et al. | 518/700 |
| 5,504,118 | 4/1996 | Benham et al. | 518/719 |
| 5,506,272 | 4/1996 | Benham et al. | 518/700 |
| 5,522,983 | 6/1996 | Cash et al. | 208/59 |
| 5,538,522 | 7/1996 | Ahmed | 44/412 |
| 5,543,437 | 8/1996 | Benham et al. | 518/700 |
| 5,545,674 | 8/1996 | Behrmann et al. | 518/715 |
| 5,689,031 | 11/1997 | Berlowitz et al. | 585/734 |

FOREIGN PATENT DOCUMENTS

| | | | |
|---|---|---|---|
| 0441014B1 | 4/1993 | (EP) | C10L/1/22 |
| 0542528A1 | 5/1993 | (EP) . | |
| 0555006A1 | 8/1993 | (EP) | C10L/1/22 |
| 0566348A | 10/1993 | (EP) . | |
| 0566348A2 | 10/1993 | (EP) | B01J/29/02 |
| 0587245A1 | 3/1994 | (EP) . | |
| 0587246 | 3/1994 | (EP) . | |
| 0634472A1 | 1/1995 | (EP) | C10L/1/14 |
| 0480957B1 | 8/1995 | (EP) | C10L/1/14 |
| 0668342A1 | 8/1995 | (EP) . | |
| 0753563A1 | 1/1997 | (EP) . | |
| 0569228B1 | 6/1998 | (EP) | C10L/1/14 |
| 732964 | 3/1932 | (FR) . | |
| 859686 | 8/1939 | (FR) . | |
| 2137490 | 4/1972 | (FR) . | |
| 2650289 | 2/1991 | (FR) . | |
| 728543 | 4/1955 | (GB) . | |
| 823010 | 11/1959 | (GB) . | |
| 848198 | 9/1960 | (GB) . | |
| 951997 | 3/1964 | (GB) . | |
| 953188 | 3/1964 | (GB) . | |
| 953189 | 3/1964 | (GB) . | |
| 1065205 | 4/1967 | (GB) | C07C/5/24 |
| 1306646 | 2/1973 | (GB) | C10G/21/16 |
| 1342499 | 1/1974 | (GB) | C10G/23/02 |
| 1342500 | 1/1974 | (GB) | B01J/11/46 |
| 1381004 | 1/1975 | (GB) | C10G/34/00 |
| 1440230 | 6/1976 | (GB) | C10G/34/00 |
| 1460476 | 1/1977 | (GB) | B26F/1/02 |
| 1493928 | 11/1977 | (GB) | C10G/23/16 |
| 1499570 | 2/1978 | (GB) | C10G/34/00 |
| 49035323 | 4/1974 | (JP) . | |
| 6200262 | 7/1991 | (JP) | C10G/45/50 |
| 2302561 | 10/1991 | (JP) . | |
| H3-231990 | 10/1991 | (JP) . | |
| 7310096 | 5/1994 | (JP) | B08B/1/00 |
| 92/01769 | 2/1992 | (WO) | C10G/73/38 |
| 92/02601 | 2/1992 | (WO) | C10L/5/00 |
| 92/14804 | 9/1992 | (WO) | C10L/1/08 |
| 97/03750 | 2/1993 | (WO) . | |
| 94/17160 | 8/1994 | (WO) | C10L/1/18 |
| 94/20593 | 9/1994 | (WO) | C10L/1/22 |
| 94/28095 | 12/1994 | (WO) | C10M/135/18 |
| 95/02695 | 1/1995 | (WO) . | |
| 95/03377 | 2/1995 | (WO) | C10L/1/14 |
| 95/06695 | 3/1995 | (WO) . | |
| 95/27021 | 10/1995 | (WO) . | |
| 96/23855 | 8/1996 | (WO) | C10L/1/14 |
| 96/26996 | 9/1996 | (WO) | C10M/133/08 |
| 97/04044 | 2/1997 | (WO) | C10L/1/18 |
| 97/14768 | 4/1997 | (WO) | C10L/1/02 |
| 97/14769 | 4/1997 | (WO) | C10L/1/08 |
| 97/21787 | 6/1997 | (WO) . | |

OTHER PUBLICATIONS

Andersson et al, "Characterization of fuels by multi–dimensional supercritical fluid chromatography and supercritical fluid chromatography–mass spectrometry", Journal of Chromatography, 641, pp. 347–355 (1993).

Di Sanzo et al, "Determination of Aromatics in Jet and Diesel Fuels by Supercritical Fluid Chromatography with Flame Ionization Detection (SFC–FID): A Quantitative Study", Journal of Chromatographic Science, vol. 29, Jan. 1991.

Lee et al, "Development of a Supercritical Fluid Chromatography Method for Determination of Aromatics in Heating Oils and Diesel Fuels", Energy & Fuels, 3, pp. 80–84 (1989), American Chemical Society.

T. L. Ullman, "Effects of Cetane Number, Cetane Improver, Aromatics, and Oxygenates on 1994 Heavy–Duty Diesel Engine Emission", SAE Paper 841020.

K. B. Spreen, "Effects of Cetane Number, Aromatics, and Oxygenates on Emissions From a 1994 Heavy–Duty Diesel Engine With Exhaust Catalyst", SAE Paper 950250.

T. L. Ullman, "Effects of Cetane Number on Emissions From a Prototype 1998 Heavy–Duty Diesel Engine", SAE Paper 950251.

J. S. Freely, "Abatement of $NO_x$ from Diesel Engines: Status & Technical Challenges", SAE Paper 950747.

J. Leyer, "Design Aspects of Lean $NO_x$ Catalysts for Gasoline & Diesel Applications", SAE Paper 952495.

M. Kawanami, "Advanced Catalyst Studies of Diesel $NO_x$ Reduction for On–Highway Trucks", SAE Paper 950154.

Anderson, "Det. of Ox and Olefin Compd Types by IR . . . ", Analyt. Chem., vol. 20, No. 11 (Nov. 1946), pp. 998–1006.

Bruner, "Syn. Gasoline From Nat. Gas", Ind. & Eng. Chem., vol. 41, No. 11 (1948), pp. 2511–2515.

Bryant, "Impr. Hydroxylamine Meth. for Det. Aldeh. & Ketones . . . ", p. 57 (Jan. 1935).

DuBois, "Det. of Bromine Addition Nos", Analyt. Chem., vol. 20, No. 7, pp. 624–627 (1948).

Friedel, "Compos. of Synth. Liquid Fuels. I . . . ", JACS 72, pp. 1212–1215 (1950).

Johnston, "Det. of Olefins in Gasoline", Analyt. Chem. 805–812 (1947).

Niederi, "Micromethods of Quantitative Organic Analysis", pp. 263–272, 2nd ed. (J. Wiley & Sons, NY 1942).

Puckett, "Ignition Qualities of HC in the Diesel Fuel Boiling Range" in information Circular Bureau of Mines 7474 (Jul. 1948).

Smith, "Rapid Det. of Hydroxyl . . . ", p. 61 (Jan. 1935).

Tilton, "Prod. of High Cetane Number Diesel Fuels by Hydrogenation", Ind. & Eng. Chemistry, vol. 40, pp. 1270–1279 (Jul. 1948).

Underwood, "Industrial Synthesis of HC from Hydrogen and Carbon Monoxide", Ind. & Eng. Chemistry, vol. 32, No. 4, pp. 450–454.

Ward, "Superfractionation Studies", Ind. & Eng. Chem. vol. 39, pp. 105–109 (109th ACS meeting).

Wheeler, "Peroxide Formation as a Meas. of Autoxidative Determination", Oil & Soap 7, 87 (1936).
Eiler, "Shell Middle Dist." Cat. Letters 7, 253–270 (1990).
Lanh, J. Cat., 129, 58–66 (1991), Convers. of Cyclohexane . . . .
Rappold, "Industry pushes use of PDC bits . . . ", J. Oil & Gas, Aug. 14, 1995.
Shah et al, USDOE/USDOC NTIS, UOP, Inc., FischerTropsch Wax Characterization and Upgrading—Final Report, DE 88–014638, Jun. 1988 ("UOP Report").
Signer, The Clean Fuels Report, "Southwest Research Institute Study Delineates The Effect of Diesel Fuel Composition on Emissions", pp. 153–158 (Jun. 1995).
Lacy, "The U.S. Army Scuffing Load Wear Test", Jan. 1, 1994.
Ryland et al, "Crackling Catalyst", Catalysis vol. VII, P. Emmett, ed., Reinhold Publ. NY (1960), pp. 5–9.
Stournas, "Eff. of Fatty Acids . . . ", JAOC S 72 (4) (1995).

SYNTHETIC DIESEL FUEL AND PROCESS FOR ITS PRODUCTION

This application is a continuation of 08/544343 filed Oct. 17, 1995.

FIELD OF THE INVENTION

This invention relates to a distillate material having a high cetane number and useful as a diesel fuel or as a blending stock therefor, as well as the process for preparing the distillate. More particularly, this invention relates to a process for preparing distillate from a Fischer-Tropsch wax.

BACKGROUND OF THE INVENTION

Clean distillates that contain no or nil sulfur, nitrogen, or aromatics, are, or will likely be in great demand as diesel fuel or in blending diesel fuel. Clean distillates having relatively high cetane number are particularly valuable. Typical petroleum derived distillates are not clean, in that they typically contain significant amounts of sulfur, nitrogen, and aromatics, and they have relatively low cetane numbers. Clean distillates can be produced from petroleum based distillates through severe hydrotreating at great expense. Such severe hydrotreating imparts relatively little improvement in cetane number and also adversely impacts the fuel's lubricity. Fuel lubricity, required for the efficient operation of fuel delivery system, can be improved by the use of costly additive packages. The production of clean, high cetane number distillates from Fischer-Tropsch waxes has been discussed in the open literature, but the processes disclosed for preparing such distillates also leave the distillate lacking in one or more important properties, e.g., lubricity. The Fischer-Tropsch distillates disclosed, therefore, require blending with other less desirable stocks or the use of costly additives. These earlier schemes disclose hydrotreating the total Fischer-Tropsch product, including the entire 700° F.– fraction. This hydro-treating results in the elimination of oxygenates from the distillate.

By virtue of this present invention small amounts of oxygenates are retained, the resulting product having both very high cetane number and high lubricity. This product is therefore useful as a diesel fuel as such, or as a blending stock for preparing diesel fuels from other lower grade material.

SUMMARY OF THE INVENTION

In accordance with this invention, a clean distillate useful as a fuel heavier than gasoline, e.g., useful as a diesel fuel or as a diesel fuel blend stock and having a cetane number of at least about 60, preferably at least about 70, more preferably at least about 74, is produced, preferably from a Fischer-Tropsch wax and preferably derived from a cobalt or ruthenium Fischer-Tropsch catalyst, by separating the waxy product into a heavier fraction and a lighter fraction. The nominal separation is at about 700° F., and the heavier fraction contains primarily 700° F.+, and the lighter fraction contains primarily 700° F.–.

The heavier fraction is subjected to hydroisomerization in the presence of a hydroisomerization catalyst, having one or more noble or non-noble metals, at normal hydroisomerization conditions, where at least a portion of the 700° F.+ material is converted to 700° F.– material. At least a portion and preferably all of the lighter fraction, preferably after separation of $C_5$–(although some $C_3$ and $C_4$ may be dissolved in the $C_5$+) remains untreated, i.e., other than by physical separation, and is blended back with at least a portion and preferably all of the hydroisomerized, 700° F.–, product. From this combined product a diesel fuel or diesel blending stock in the boiling range 250° F.–700° F. can be recovered and has the properties described below.

DESCRIPTION OF THE DRAWINGS

FIG. 1 is a schematic of a process in accordance with this invention.

DESCRIPTION OF PREFERRED EMBODIMENTS

Figure 2:
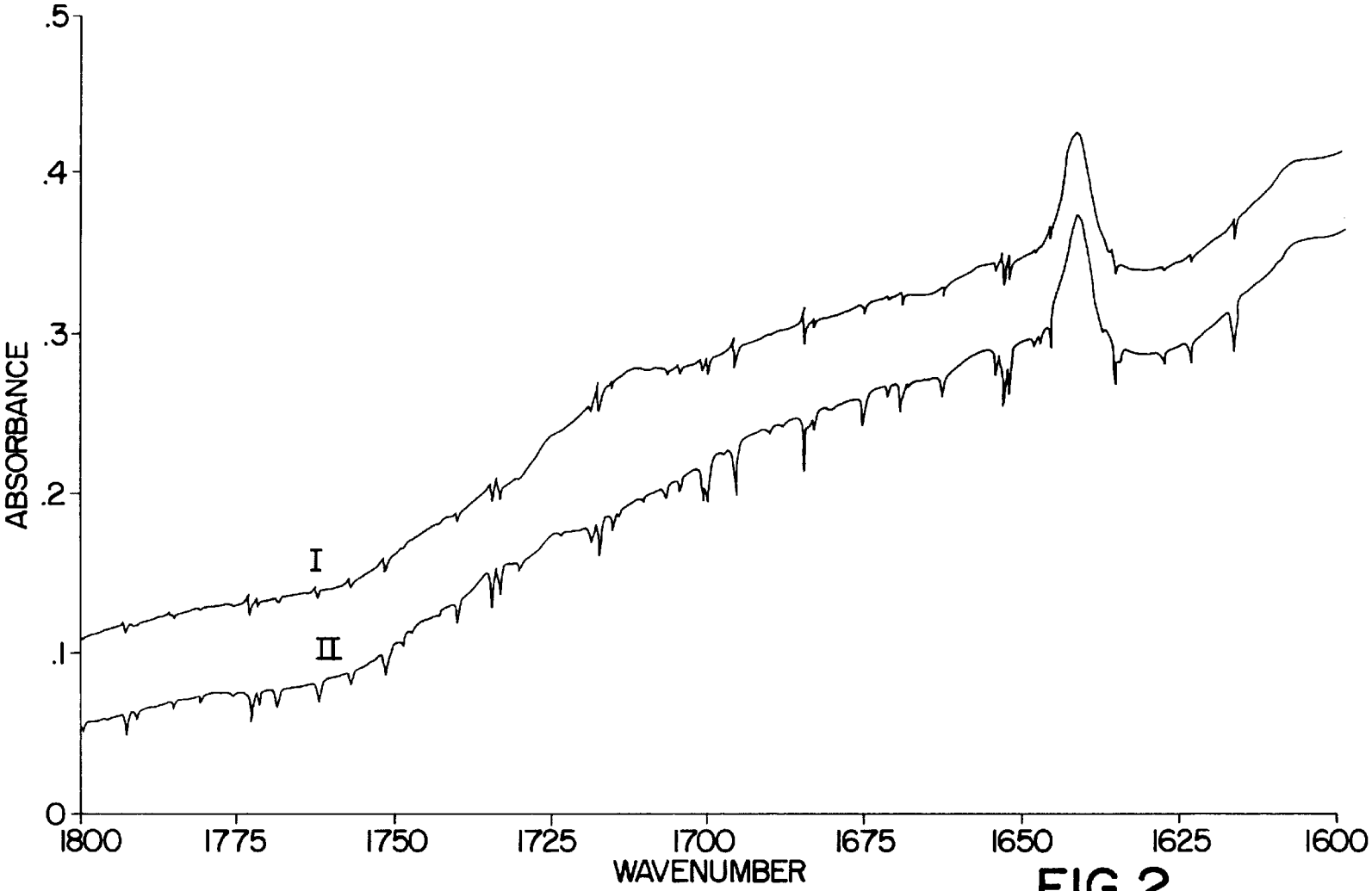
FIG. 2 shows IR absorbence spectra for two fuels: I for Diesel Fuel B, and II for Diesel Fuel B with 0.0005 mmoles/gm palnitic acid (which corresponds to 15 wppm oxygen as oxygen); absorbance on the ordinate, wave length on the abscissa.

A more detailed description of this invention may be had by referring to the drawing. Synthesis gas, hydrogen and carbon monoxide, in an appropriate ratio, contained in line 1 is fed to a Fischer-Tropsch reactor 2, preferably a slurry reactor and product is recovered in lines 3 and 4, 700° F.+ and 700° F.– respectively. The lighter fraction goes through hot separator 6 and a 500–700° F. fraction is recovered, in line 8, while a 500° F.– fraction is recovered in line 7. The 500° F.– material goes through cold separator 9 from which $C_4$-gases are recovered in line 10. A $C_5$–500° F. fraction is recovered in line 11 and is combined with the 500–700° F. fraction in line 8. At least a portion and preferably most, more preferably essentially all of this $C_5$–700 fraction is blended with the hydroisomerized product in line 12.

The heavier, e.g., 700° F.+ fraction, in line 3 is sent to hydroisomerization unit 5. Typical broad and preferred conditions for the hydroisomerization process unit are shown in the table below:

| Condition | Broad Range | Preferred Range |
|---|---|---|
| Temperature, ° F. | 300–800 | 550–750 |
| Total Pressure, psig | 0–2500 | 300–1200 |
| Hydrogen Treat Rate, SCF/B | 500–5000 | 2000–4000 |
| Hydrogen Consumption Rate, SCF/B | 50–500 | 100–300 |

While virtually any catalyst useful in hydroisomerization or selective hydrocracking may be satisfactory for this step, some catalysts perform better than others and are preferred. For example, catalysts containing a supported Group VIII noble metal, e.g., platinum or palladium, are useful as are catalysts containing one or more Group VIII base metals, e.g., nickel, cobalt, in amounts of about 0.5–20 wt % which may or may not also include a Group VI metal, e.g., molybdenum, in amounts of about 1–20 wt %. The support for the metals can be any refractory oxide or zeolite or mixtures thereof. Preferred supports include silica, alumina, silica-alumina, silica-alumina phosphates, titania, zirconia, vanadia and other Group III, IV, VA or VI oxides, as well as Y sieves, such as ultrastable Y sieves. Preferred supports include alumina and silica-alumina where the silica concentration of the bulk support is less than about 50 wt %, preferably less than about 35 wt %.

A preferred catalyst has a surface area in the range of about 180–400 $m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The preferred catalysts comprise a non-noble Group VIII metal, e.g., iron, nickel, in conjunction with a Group IB metal, e.g., copper, supported on an acidic support. The support is preferably an amorphous silica-alumina where the alumina is present in amounts of less than about 30 wt %, preferably 5–30 wt %, more preferably 10–20 wt %. Also, the support may contain small amounts, e.g., 20–30 wt %, of a binder, e.g., alumina, silica, Group IVA metal oxides, and various types of clays, magnesia, etc., preferably alumina. The catalyst is prepared by coimpregnating the metals from solutions onto the support, drying at 100–150° C., and calcining in air at 200–550° C.

The preparation of amorphous silica-alumina microspheres for supports is described in Ryland, Lloyd B., Tamele, M. W., and Wilson, J. N., Cracking Catalysts, Catalysis: volume VII, Ed. Paul H. Emmett, Reinhold Publishing Corporation, New York, 1960, pp. 5–9.

The Group VIII metal is present in amounts of about 15 wt% or less, preferably 1–12 wt %, while the Group IB metal is usually present in lesser amounts, e.g., 1:2 to about 1:20 ratio respecting the Group VIII metal. A typical catalyst is shown below:

| | |
|---|---|
| Ni, wt % | 2.5–3.5 |
| Cu, wt % | 0.25–0.35 |
| $Al_2O_3$—$S_iO_2$ | 65–75 |
| $Al_2O_3$ (binder) | 25–30 |
| Surface Area | 290–355 $m^2$/gm |
| Pour Volume (Hg) | 0.35–0.45 ml/gm |
| Bulk Density | 0.58–0.68 g/ml |

The 700° F.+ conversion to 700° F.− in the hydroisomerization unit ranges from about 20–80%, preferably 20–50%, more preferably about 30–50%. During hydroisomerization essentially all olefins and oxygen containing materials are hydrogenated.

The hydroisomerization product is recovered in line 12 into which the $C_5$–700° F. stream of lines 8 and 11 are blended. The blended stream is fractionated in tower 13, from which 700° F.+ is, optionally, recycled in line 14 back to line 3, $C_5$− is recovered in line 16 and a clean distillate boiling in the range of 250–700° F. is recovered in line 15. This distillate has unique properties and may be used as a diesel fuel or as a blending component for diesel fuel. Light gases may be recovered in line 16 and combined in line 17 with the light gases from the cold separator 9 and used for fuel or chemicals processing.

The diesel material recovered from the fractionator 13, has the properties shown below:

| | |
|---|---|
| paraffins | at least 95 wt %, preferably at least 96 wt %, more preferably at least 97 wt %, still more preferably at least 98 wt %, and most preferably at least 99 wt %; |
| iso/normal ratio | about 0.3 to 3.0, preferably 0.7–2.0; |
| sulfur | ≦50 ppm (wt), preferably nil; |
| nitrogen | ≦50 ppm (wt), preferably ≦20 ppm, more preferably nil; |
| unsaturates (olefins and aromatics) | ≦2 wt %; |
| oxygenates | about 0.001 to less than 0.3 wt % oxygen water-free basis |

The iso paraffins are preferably mono methyl branched, and since the process utilizes Fischer-Tropsch wax, the product contains nil cyclic paraffins, e.g., no cyclohexane.

The oxygenates are contained essentially, e.g., >95% of the oxygenates, in the lighter fraction, e.g., the 700° F.− fraction. Further, the olefin concentration of the lighter fraction is sufficiently low as to make olefin recovery unnecessary; and further treatment of the fraction for olefins is avoided.

The preferred Fischer-Tropsch process is one that utilizes a non-shifting (that is, no water gas shift capability) catalyst, such as cobalt or ruthenium or mixtures thereof, preferably cobalt, and preferably a promoted cobalt, the promoter being zirconium or rhenium, preferably rhenium. Such catalysts are well known and a preferred catalyst is described in U.S. Pat. No. 4,568,663 as well as European Patent 0 266 898. The hydrogen:CO ratio in the process is at least about 1.7, preferably at least about 1.75, more preferably 1.75 to 2.5.

The products of the Fischer-Tropsch process are primarily paraffinic hydrocarbons. Ruthenium produces paraffins primarily boiling in the distillate range, i.e., $C_{10}$–$C_{20}$; while cobalt catalysts generally produce more of heavier hydrocarbons, e.g., $C_{20}$+, and cobalt is a preferred Fischer-Tropsch catalytic metal.

Diesel fuels generally have the properties of high cetane number, usually 50 or higher, preferably at least about 60, more preferably at least about 65, lubricity, oxidative stability, and physical properties compatible with diesel pipeline specifications.

The product of this invention may be used as a diesel fuel, per se, or blended with other less desirable petroleum or hydrocarbon containing feeds of about the same boiling range. When used as a blend, the product of this invention can be used in relatively minor amounts, e.g., 10% or more, for significantly improving the final blended diesel product. Although, the product of this invention will improve almost any diesel product, it is especially desirable to blend this product with refinery diesel streams of low quality. Typical streams are raw or hydrogenated catalytic or thermally cracked distillates and gas oils.

By virtue of using the Fischer-Tropsch process, the recovered distillate has nil sulfur and nitrogen. These hereto-atom compounds are poisons for Fischer-Tropsch catalysts and are removed from the methane containing natural gas that is a convenient feed for the Fischer-Tropsch process. (Sulfur and nitrogen containing compounds are, in any event, in exceedingly low concentrations in natural gas.) Further, the process does not make aromatics, or as usually operated, virtually no aromatics are produced. Some olefins are produced since one of the proposed pathways for the production of paraffins is through an olefinic intermediate. Nevertheless, olefin concentration is usually quite low.

Oxygenated compounds including alcohols and some acids are produced during Fischer-Tropsch processing, but in at least one well known process, oxygenates and unsaturates are completely eliminated from the product by hydrotreating. See, for example, The Shell Middle Distillate Process, Eiler, J.; Posthuma, S.A.; Sie, S.T., Catalysis Letters, 1990, wt, 253–270.

We have found, however, that small amounts of oxygenates, preferably alcohols, usually concentrated in the 700° F.− fraction and preferably in the 500–700° F. fraction, more preferably in the 600–700° F. fraction, provide exceptional lubricity for diesel fuels. For example, as illustrations will show, a highly paraffinic diesel fuel with small amounts of oxygenates has excellent lubricity as shown by the BOCLE test (ball on cylinder lubricity evaluator). However, when the oxygenates were removed, for example, by extraction, absorbtion over molecular sieves, hydroprocessing, etc., to a level of less than 10 ppm wt% oxygen (water free basis) in the fraction being tested, the lubricity was quite poor.

By virtue of the processing scheme disclosed in this invention the lighter, 700° F.– fraction is not subjected to any hydrotreating. In the absence of hydrotreating of the lighter fraction, the small amount of oxygenates, primarily linear alcohols, in this fraction are preserved, while oxygenates in the heavier fraction are eliminated during the hydroisomerization step. Hydroisomerization also serves to increase the amount of iso paraffins in the distillate fuel and helps the fuel to meet pour point and cloud point specifications, although additives may be employed for these purposes.

The oxygen compounds that are believed to promote lubricity may be described as having a hydrogen bonding energy greater than the bonding energy of hydrocarbons (the energy measurements for various compounds are available in standard references); the greater the difference, the greater the lubricity effect. The oxygen compounds also have a lipophilic end and a hydrophilic end to allow wetting of the fuel.

Preferred oxygen compounds, primarily alcohols, have a relatively long chain, i.e., $C_{12}$+, more preferably $C_{12}$+$C_{24}$ primary linear alcohols.

While acids are oxygen containing compounds, acids are corrosive and are produced in quite small amounts during Fischer-Tropsch processing at non-shift conditions. Acids are also di-oxygenates as opposed to the preferred mono-oxygenates illustrated by the linear alcohols. Thus, di or poly-oxygenates are usually undetectable by infra red measurements and are, e.g., less than about 15 wppm oxygen as oxygen.

Non-shifting Fischer-Tropsch reactions are well known to those skilled in the art and may be characterized by conditions that minimize the formations of $CO_2$ byproducts. These conditions can be achieved by a variety of methods, including one or more of the following: operating at relatively low CO partial pressures, that is, operating at hydrogen to CO ratios of at least about 1.7/1, preferably about 1.7/1 to about 2.5/1, more preferably at least about 1.9/1, and in the range 1.9/1 to about 2.3/1, all with an alpha of at least about 0.88, preferably at least about 0.91; temperatures of about 175–225° C., preferably 180–210° C.; using catalysts comprising cobalt or ruthenium as the primary Fischer-Tropsch catalysts agent.

The amount of oxygenates present, as oxygen on a water free basis is relatively small to achieve the desired lubricity, i.e., at least about 0.001 wt% oxygen (water free basis), preferably 0.001–0.3 wt % oxygen (water free basis), more preferably 0.0025–0.3 wt % oxygen (water free basis).

The following examples will serve to illustrate, but not limit, this invention.

Hydrogen and carbon monoxide synthesis gas ($H_2$:CO 2.11–2.16) were converted to heavy paraffins in a slurry Fischer-Tropsch reactor. The catalyst utilized for the Fischer-Tropsch reaction was a titania supported cobalt/rhenium catalyst previously described in US Pat. No. 4,568,663. The reaction conditions were 422–428° F., 287–289 psig, and a linear velocity of 12 to 17.5 cm/sec. The alpha of the Fischer-Tropsch synthesis step was 0.92. The paraffinic Fischer-Tropsch product was then isolated in three nominally different boiling streams, separated utilizing a rough flash. The three approximate boiling fractions were: 1) the $C_5$+500° F. boiling fraction, designated below as F–T Cold Separator Liquids; 2) The 500–700° F. boiling fraction designated below as F–T Hot Separator Liquids; and 3) the 700° F.+ boiling fraction designated below as F–T Reactor Wax.

EXAMPLE 1

Seventy wt % of a Hydroisomerized F-T Reactor Wax, 16.8 wt % Hydrotreated F–T Cold Separator Liquids and 13.2 wt% Hydrotreated F–T Hot Separator Liquids were combined and rigorously mixed. Diesel Fuel A was the 260–700° F. boiling fraction of this blend, as isolated by distillation, and was prepared as follows: The hydroisomerized F-T Reactor Wax was prepared in flow through, fixed bed unit using a cobalt and molybdenum promoted amorphous silica-alumina catalyst, as described in U.S. Pat. No. 5,292,989 and U.S. Pat. No. 5,378,348. Hydroisomerization conditions were 708° F., 750 psig $H_2$, 2500 SCF/B $H_2$, and a liquid hourly space velocity (LHSV) of 0.7–0.8. Hydroisomerization was conducted with recycle of unreacted 700° F.+ reactor wax. The Combined Feed Ratio, (Fresh Feed+Recycle Feed)/Fresh Feed equaled 1.5. Hydrotreated F–T Cold and Hot Separator Liquid were prepared using a flow through fixed bed reactor and commercial massive nickel catalyst. Hydrotreating conditions were 450° F., 430 psig $H_2$, 1000 SCF/B $H_2$, and 3.0 LHSV. Fuel A is representative of a typical completely hydrotreated cobalt derived Fischer-Tropsch diesel fuel, well known in the art.

EXAMPLE 2

Seventy Eight wt % of a Hydroisomerized F–T Reactor Wax, 12 wt % Unhydrotreated F-T Cold Separator Liquids, and 10 wt % F–T Hot Separator Liquids were combined and mixed. Diesel Fuel B was the 250–700° F. boiling fraction of this blend, as isolated by distillation, and was prepared as follows: The Hydroisomerized F-T Reactor Wax was prepared in flow through, fixed bed unit using a cobalt and molybdenum promoted amorphous silica-alumina catalyst, as described in U.S. Pat. No. 5,292,989 and U.S. Pat. No. 5,378,348. Hydroisomerization conditions were 690° F., 725 psig $H_2$, 2500 SCF/B $H_2$, and a liquid hourly space velocity (LHSV) of 0.6–0.7. Fuel B is a representative example of this invention.

EXAMPLE 3

Diesel Fuels C and D were prepared by distilling Fuel B into two fractions. Diesel Fuel C represents the 250 to 500° F. fraction of Diesel Fuel B. Diesel Fuel D represents the 500–700° F. fraction of Diesel Fuel B.

EXAMPLE 4

100.81 grams of Diesel Fuel B was contacted with 33.11 grams of Grace Silico-aluminate zeolite: 13X Grade 544, 8–12 mesh beads. Diesel Fuel E is the filtrated liquid resulting from this treatment. This treatment effectively removes alcohols and other oxygenates from the fuel.

EXAMPLE 5

Diesel Fuel F is a hydrotreated petroleum stream composed of approximately 40% cat distillate and 60% virgin distillate. It was subsequently hydrotreated in a commercial hydrotreater. The petroleum fraction has a boiling range of 250–800° F., contains 663 ppm sulfur (x-ray), and 40% FIA aromatics. Diesel Fuel F represents a petroleum base case for this invention.

EXAMPLE 6

Diesel Fuel G was prepared by combining equal amounts of Diesel Fuel B with a Diesel Fuel F. Diesel Fuel G should contain 600 ppm total oxygen (neutron activation), 80 ppm 500+° F. boiling primary alcohols the (GC/MS), and signal for primary alcohols indicates 320 ppm total oxygen as primary alcohols ($^1$H NMR; 250–700° F.). Diesel Fuel G represents an additional example for this invention where both HCS and petroleum distillates are used to comprise the diesel fuel.

EXAMPLE 7

Oxygenate, dioxygenate, and alcohol composition of Diesel Fuels A, B, and E were measured using Proton Nuclear Magnetic Resonance ($^1$H-NMR), Infrared Spectroscopy (IR), and Gas Chromatography/Mass Spectrometry (GC/MS). $^1$H-NMR experiments were done using a Brucker MSL-500 Spectrometer. Quantitative data were obtained by measuring the samples, dissolved in $CDC1_3$, at ambient temperature, using a frequency of 500.13 MHz, pulse width of 2.9 $\mu$s (45 degree tip angle), delay of 60 s, and 64 scans. Tetramethylsilane was used as an internal reference in each case and dioxane was used as an internal standard. Levels of primary alcohols, secondary alcohols, esters and acids were estimated directly by comparing integrals for peaks at 3.6 (2H), 3.4 (1H), 4.1 (2H) and 2.4 (2H) ppm respectively, with that of the internal standard. IR Spectroscopy was done using a Nicolet 800 spectro-meter. Samples were prepared by placing them in a KBr fixed path length cell (nominally 1.0 mm) and acquisition was done by adding 4096 scans a 0.3 $cm^{-1}$ resolution. Levels of dioxygenates, such as carboxylic acids and esters, were measured using the absorbance at 1720 and 1738 $cm^{-1}$, respectively. GC/MS were performed using either a Hewlett-Packard 5980/Hewlett-Packard 5970B Mass Selective Detector Combination (MSD) or Kratos Model MS-890 GC/MS. Selected ion monitoring of m/z 31 ($CH_3O$+) was used to quantify the primary alcohols. An external standard was made by weighing $C_2$–$C_{14}$, $C_{16}$ and $C_{18}$ primary alcohols into a mixture of $C_8$–$C_{16}$ normal paraffins. Olefins were determined using Bromine Index, as described in ASTM D 2710. Results from these analyses are presented in Table 1. Diesel Fuel B which contains the unhydrotreated hot and cold separator liquids contains a significant amount of oxygenates as linear, primary alcohols. A significant fraction of these are the important $C_{12}$–$C_{18}$ primary alcohols. It is these alcohols that impart superior performance in diesel lubricity. Hydrotreating (Diesel Fuel A) is extremely effective at removing essentially all of the oxygenates and olefins. Mole sieve treatment (Diesel Fuel E) also is effective at removing the alcohol contaminants without the use of process hydrogen. None of these fuels contain significant levels of dioxygenates, such as carboxylic acids or esters. A sample IR spectrum for Diesel Fuel B is shown in FIG. 2.

TABLE 1

Oxygenate, and dioxygenate (carboxylic acids, esters) composition of All Hydrotreated Diesel Fuel (Diesel Fuel A), Partially Hydrotreated Diesel Fuel (Diesel Fuel B0, and the Mole Sieve Treated, Partially Hydrotreated Diesel Fuel (Diesel Fuel E).

| | Diesel Fuel A | Diesel Fuel B | Diesel Fuel E |
|---|---|---|---|
| wppm Oxygen in dioxygenates, (carboxylic acids, esters) - (IR) | None Detected | None Detected | None Detected |
| wppm Oxygen in $C_5$–$C_{18}$ primary alcohols - ($^1$H NMR) | None Detected | 640 ppm | None Detected |
| wppm Oxygen in $C_5$–$C_{18}$ primary alcohols - (GC/MS) | 5.3 | 824 | None Detected |

TABLE 1-continued

Oxygenate, and dioxygenate (carboxylic acids, esters) composition of All Hydrotreated Diesel Fuel (Diesel Fuel A), Partially Hydrotreated Diesel Fuel (Diesel Fuel B0, and the Mole Sieve Treated, Partially Hydrotreated Diesel Fuel (Diesel Fuel E).

| | Diesel Fuel A | Diesel Fuel B | Diesel Fuel E |
|---|---|---|---|
| wppm Oxygen in $C_{12}$–$C_{18}$ primary alcohols - (GC/MS) | 3.3 | 195 ppm | None Detected |
| Total Olefins - mmol/g (Bromine Index, ASTM D 2710) | 0.004 | 0.78 | — |

EXAMPLE 8

Diesel Fuels A–G were all tested using a standard Ball on Cylinder Lubricity Evaluation (BOCLE), further described as Lacey, P. I. "The U.S. Army Scuffing Load Wear Test", Jan. 1, 1994. This test is based on ASTM D 5001. Results are reported in Table 2 as percents of Reference Fuel 2, described in Lacey.

TABLE 2

BOCLE results for Fuels A–G. Results reported as percents of Reference Fuel 2 as described in

| Diesel Fuel | % Reference Fuel 2 |
|---|---|
| A | 42.1 |
| B | 88.9 |
| C | 44.7 |
| D | 94.7 |
| E | 30.6 |
| F | 80.0 |
| G | 84.4 |

The completely hydrotreated Diesel Fuel A, exhibits very low lubricity typical of an all paraffin diesel fuel. Diesel Fuel B, which contains a high level of oxygenates as linear, $C_5$–$C_{24}$ primary alcohols, exhibits significantly superior lubricity properties. Diesel Fuel E was prepared by separating the oxygenates away from Diesel Fuel B through adsorption by 13X molecular sieves. Diesel Fuel E exhibits very poor lubricity indicating the linear $C_5$–$C_{24}$ primary alcohols are responsible for the high lubricity of Diesel Fuel B. Diesel Fuels C and D represent the 250–500° F. and the 500–700° F. boiling fractions of Diesel Fuel B, respectively. Diesel Fuel C contains the linear $C_5$–$C_{11}$ primary alcohols that boil below 500° F., and Diesel Fuel D contains the $C_{12}$–$C_{24}$ primary alcohols that boil between 500–700° F. Diesel Fuel D exhibits superior lubricity properties compared to Diesel Fuel C, and is in fact superior in performance to Diesel Fuel B from which it is derived. This clearly indicates that the $C_{12}$–$C_{24}$ primary alcohols that boil between 500–700° F. are important to producing a high lubricity saturated diesel fuel. Diesel Fuel F is representative of petroleum derived low sulfur diesel fuel, and although it exhibits reasonably high lubricity properties it is not as high as the highly paraffinic Diesel Fuel B. Diesel Fuel G is the 1:1 blend of Diesel Fuel B and Diesel Fuel F and it exhibits improved lubricity performance compared to Diesel F. This indicates that the highly paraffinic Diesel Fuel B is not only a superior neat fuel composition, but also an outstanding diesel blending component capable of improving the properties of petroleum derived low sulfur diesel fuels.

What is claimed is:

1. A material useful as a fuel heavier than gasoline or as a blending component for a distillate fuel comprising: a 250–700° F. fraction derived from a non-shifting Fischer-Tropsch catalyst process and containing at least 95 wt % paraffins with an iso to normal ratio of about 0.3 to 3.0, <50 ppm (wt) of sulfur and nitrogen less than about 2 wt % unsaturates, and about 0.001 to less than 0.3 wt % oxygen.

2. The material of claim 1 wherein the oxygen is present primarily as linear alcohols.

3. The material of claim 2 wherein the linear alcohols are $C_{12}$+.

4. The material of claim 3 characterized by a cetane number of at least 70.

5. The material of claim 1 wherein the content of nitrogen and sulfur is less than or equal to 15 ppm (wt).

6. The material of claim 1 wherein the content of nitrogen and sulfur is less than or equal to 10 ppm (wt).

7. wt A blended fuel, useful as a diesel fuel, comprising:

(a) a 250–700° F. distillate fraction derived from the Fischer-Tropsch process which contains;

at least 95 wt % paraffins with an iso to normal ratio of about 0.3 to 3.0,

<50 ppm (wt) each of sulfur and nitrogen, less than about 2 wt % unsaturates about 0.001 to less than 0.3 wt% linear oxygenate, as oxygen on a water free basis, blended with (b) a petroleum derived hydrocarbon fraction, wherein the Fischer-Tropsch fraction comprises at least 10% of the blended fuel.

8. A blend according to claim 7 wherein said Fischer-Tropsch process is a non-shifting Fischer-Tropsch catalyst process.

9. A blend according to claim 6 wherein said Fischer-Tropsch catalyst comprises cobalt.

10. A blend according to claim 7 wherein said petroleum derived hydrocarbon boils in the range of about 250–700° F.

11. A blend according to claim 7 or 10 wherein said petroleum derived hydrocarbon is selected from the group consisting of raw thermally cracked distillates, hydrogenated catalytically cracked distillates and gas oils.

* * * * *